US009108381B2

(12) United States Patent
Steele

(10) Patent No.: US 9,108,381 B2
(45) **Date of Patent: *Aug. 18, 2015**

(54) MULTI-COMPARTMENT FLEXIBLE PACKAGE

(76) Inventor: Mark Steele, New Prague, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/161,464

(22) Filed: Jun. 15, 2011

(65) Prior Publication Data

US 2012/0006702 A1 Jan. 12, 2012

Related U.S. Application Data

(60) Continuation of application No. 11/857,292, filed on Sep. 18, 2007, now abandoned, which is a division of application No. 10/456,971, filed on Jun. 6, 2003, now abandoned.

(60) Provisional application No. 60/386,798, filed on Jun. 6, 2002.

(51) Int. Cl.

| | |
|---|---|
| ***B31B 37/00*** | (2006.01) |
| ***B31B 23/00*** | (2006.01) |
| ***B65D 30/08*** | (2006.01) |
| ***B65D 30/22*** | (2006.01) |
| ***B65D 33/00*** | (2006.01) |
| ***B65D 75/58*** | (2006.01) |
| *B65D 75/00* | (2006.01) |

(52) U.S. Cl.

CPC ..... *B31B 37/00* (2013.01); *B31B 23/00* (2013.01); *B65D 31/02* (2013.01); *B65D 31/12* (2013.01); *B65D 33/007* (2013.01); *B65D 75/5805* (2013.01); *B31B 2237/10* (2013.01); *B31B 2237/20* (2013.01); *B31B 2237/50* (2013.01); *B65D 75/008* (2013.01)

(58) Field of Classification Search

CPC ..... B65D 31/12; B65D 81/3261; B65D 33/2566; B65D 33/004; B65D 29/00; B65D 81/3266; A45C 3/00; A45C 13/02; A45C 7/0095; A45C 13/42; B29C 66/81427; B29C 65/76; A47J 36/16

USPC ..... 383/38, 39, 40; 493/186, 189, 193–202, 493/210, 218, 231

See application file for complete search history.

(56) References Cited

U.S. PATENT DOCUMENTS

| | | | | | |
|---|---|---|---|---|---|
| 1,940,221 | A | * | 12/1933 | Miller | 383/40 |
| 2,437,149 | A | * | 3/1948 | Baxter | 383/38 |
| 2,688,914 | A | * | 9/1954 | Eckler | 100/211 |
| 2,720,903 | A | * | 10/1955 | Pickren | 206/102 |
| 2,756,875 | A | * | 7/1956 | Yochim | 206/219 |
| 2,761,481 | A | * | 9/1956 | Boatwright | 383/22 |
| 2,952,395 | A | | 9/1960 | Spees | |
| 3,133,575 | A | * | 5/1964 | Slemmons | 206/568 |
| 3,143,278 | A | | 8/1964 | Hiebert | |
| 3,151,650 | A | * | 10/1964 | Beck | 206/568 |

(Continued)

*Primary Examiner* — Jes F Pascua
*Assistant Examiner* — Peter Helvey
(74) *Attorney, Agent, or Firm* — Skaar Ulbrich Macari, PA

(57) ABSTRACT

A flexible package having a main package inner cavity compartment and a segregated secondary compartment. The main package generally includes a plurality of outer panel portions. These panel portions can include a front panel portion, a back panel portion, and a bottom panel portion. A frangible longitudinal seal portion is provided such that breaching of the frangible longitudinal seal portion facilitates communication between the inner cavity and the secondary compartment.

22 Claims, 10 Drawing Sheets

(56) References Cited

U.S. PATENT DOCUMENTS

| | | | | | |
|---|---|---|---|---|---|
| 3,159,096 | A | * | 12/1964 | Tocker | 100/211 |
| 3,224,640 | A | * | 12/1965 | Schneider et al. | 222/107 |
| 3,294,227 | A | * | 12/1966 | Schneider et al. | 206/219 |
| 3,339,721 | A | | 9/1967 | Goldstein | |
| 3,390,507 | A | * | 7/1968 | Repko | 53/412 |
| 3,419,137 | A | * | 12/1968 | Walck, III | 206/364 |
| 3,469,768 | A | | 9/1969 | Repko | |
| 3,542,032 | A | * | 11/1970 | Spencer, Jr. | 607/114 |
| 3,608,709 | A | * | 9/1971 | Pike | 206/219 |
| 3,762,628 | A | * | 10/1973 | Sargent | 383/40 |
| 4,145,449 | A | * | 3/1979 | Nelham | 426/120 |
| 4,201,031 | A | * | 5/1980 | Wiles | 53/455 |
| 4,256,256 | A | * | 3/1981 | Meyers | 383/40 |
| 4,402,402 | A | * | 9/1983 | Pike | 206/219 |
| 4,496,046 | A | * | 1/1985 | Stone et al. | 206/219 |
| 4,519,499 | A | * | 5/1985 | Stone et al. | 206/219 |
| 4,557,377 | A | * | 12/1985 | Maloney | 206/219 |
| 4,588,554 | A | * | 5/1986 | Kaartinen et al. | 422/430 |
| 4,619,361 | A | * | 10/1986 | Thomas, Jr. | 206/204 |
| 4,711,359 | A | | 12/1987 | White et al. | |
| 4,715,963 | A | * | 12/1987 | Jones | 210/781 |
| 4,790,670 | A | * | 12/1988 | Barbaro | 383/62 |
| 4,806,021 | A | * | 2/1989 | Koudstaal et al. | 383/40 |
| 4,877,334 | A | * | 10/1989 | Cope | 383/3 |
| 4,991,980 | A | | 2/1991 | Cohen et al. | |
| 5,060,803 | A | * | 10/1991 | Beer et al. | 383/200 |
| 5,116,301 | A | | 5/1992 | Robinson et al. | |
| 5,149,202 | A | * | 9/1992 | Dickert | 383/106 |
| 5,169,651 | A | | 12/1992 | Heiber et al. | |
| 5,198,055 | A | * | 3/1993 | Wirth et al. | 156/66 |
| 5,209,347 | A | * | 5/1993 | Fabisiewicz et al. | 206/219 |
| 5,335,478 | A | * | 8/1994 | Aronsen | 53/412 |
| 5,353,927 | A | * | 10/1994 | Stupar et al. | 206/219 |
| 5,373,966 | A | * | 12/1994 | O'Reilly et al. | 222/94 |
| 5,380,093 | A | * | 1/1995 | Goldman | 383/38 |
| 5,407,278 | A | * | 4/1995 | Beer | 383/38 |
| 5,409,116 | A | * | 4/1995 | Aronsen | 206/484 |
| 5,487,470 | A | * | 1/1996 | Pharo | 206/522 |
| 5,492,219 | A | * | 2/1996 | Stupar | 206/219 |
| 5,611,626 | A | * | 3/1997 | Warr | 383/10 |
| 5,660,868 | A | * | 8/1997 | Yeager | 426/124 |
| 5,664,303 | A | | 9/1997 | Johnson | |
| 5,672,009 | A | | 9/1997 | Malin | |
| 5,709,479 | A | * | 1/1998 | Bell | 383/209 |
| 5,782,733 | A | | 7/1998 | Yeager | |
| 5,785,428 | A | * | 7/1998 | Mazzocchi | 383/103 |
| 5,788,378 | A | * | 8/1998 | Thomas | 383/63 |
| 5,803,256 | A | * | 9/1998 | Lydhig et al. | 206/440 |
| 5,806,984 | A | | 9/1998 | Yeager | |
| 5,829,884 | A | | 11/1998 | Yeager | |
| 5,845,769 | A | * | 12/1998 | Yeager | 206/204 |
| 5,882,120 | A | * | 3/1999 | Bell | 383/204 |
| 5,902,047 | A | | 5/1999 | Yeager | |
| 5,951,453 | A | | 9/1999 | Yeager | |
| 5,954,433 | A | | 9/1999 | Yeager | |
| 6,023,914 | A | * | 2/2000 | Richison et al. | 53/410 |
| 6,036,004 | A | * | 3/2000 | Bowen | 206/219 |
| 6,053,635 | A | | 4/2000 | Anderson et al. | |
| 6,065,872 | A | * | 5/2000 | Johnson | 383/63 |
| 6,115,892 | A | * | 9/2000 | Malin et al. | 24/585.12 |
| 6,126,317 | A | | 10/2000 | Anderson et al. | |
| 6,224,262 | B1 | | 5/2001 | Hogan et al. | |
| 6,234,675 | B1 | * | 5/2001 | Saad et al. | 383/38 |
| 6,245,367 | B1 | * | 6/2001 | Galomb | 426/115 |
| 6,298,983 | B1 | * | 10/2001 | Yeager | 206/204 |
| 6,352,365 | B1 | | 3/2002 | Healy et al. | |
| 6,354,738 | B1 | * | 3/2002 | Buckman et al. | 383/5 |
| 6,371,643 | B2 | * | 4/2002 | Saad et al. | 383/63 |
| 6,375,037 | B1 | * | 4/2002 | Bell et al. | 222/1 |
| 6,478,465 | B1 | * | 11/2002 | Thrall | 383/205 |
| 6,499,600 | B2 | * | 12/2002 | Koyanagi | 206/524.8 |
| 6,547,468 | B2 | * | 4/2003 | Gruenbacher et al. | 401/133 |
| 6,641,307 | B2 | * | 11/2003 | Matsuda et al. | 383/38 |
| 6,659,643 | B2 | | 12/2003 | Plourde et al. | |
| 6,702,461 | B2 | * | 3/2004 | Vangedal-Nielsen | 383/38 |
| 6,789,945 | B2 | * | 9/2004 | Mobs et al. | 383/37 |
| 6,820,391 | B2 | * | 11/2004 | Barmore et al. | 53/133.4 |
| 6,874,938 | B2 | * | 4/2005 | Price et al. | 383/109 |
| 6,968,952 | B2 | * | 11/2005 | Crevier et al. | 206/484 |
| 7,040,810 | B2 | * | 5/2006 | Steele | 383/66 |
| 7,207,717 | B2 | | 4/2007 | Steele | |
| D549,594 | S | | 8/2007 | Steele | |
| D621,280 | S | | 8/2010 | Steele | |
| 7,883,268 | B2 | | 2/2011 | Steele | |
| 2001/0030134 | A1 | * | 10/2001 | Goglio et al. | 206/221 |
| 2002/0067865 | A1 | * | 6/2002 | Stutzman | 383/38 |
| 2003/0059128 | A1 | * | 3/2003 | Vangedal-Nielsen | 383/4 |
| 2003/0210838 | A1 | | 11/2003 | Steele | |
| 2004/0031244 | A1 | * | 2/2004 | Steele | 53/450 |
| 2005/0069227 | A1 | | 3/2005 | Steele | |
| 2006/0113212 | A1 | | 6/2006 | Steele | |
| 2006/0215942 | A1 | | 9/2006 | Steele | |
| 2007/0189641 | A1 | | 8/2007 | Steele | |
| 2007/0206888 | A1 | | 9/2007 | Chang | |
| 2007/0269142 | A1 | * | 11/2007 | Tyska et al. | 383/38 |
| 2008/0002918 | A1 | * | 1/2008 | Steele | 383/38 |
| 2008/0240628 | A1 | | 10/2008 | VanLoocke et al. | |
| 2008/0279485 | A1 | | 11/2008 | Steele | |
| 2008/0296310 | A1 | | 12/2008 | Steele, IV et al. | |
| 2009/0080810 | A9 | * | 3/2009 | Steele | 383/38 |
| 2009/0175563 | A1 | * | 7/2009 | Weaver | 383/38 |
| 2009/0180716 | A1 | | 7/2009 | Steele | |
| 2009/0208147 | A1 | | 8/2009 | Steele | |
| 2009/0238499 | A1 | * | 9/2009 | Steele | 383/200 |
| 2009/0245699 | A1 | | 10/2009 | Steele | |
| 2009/0277916 | A1 | | 11/2009 | Steele | |
| 2010/0012531 | A1 | | 1/2010 | Steele | |
| 2010/0226600 | A1 | | 9/2010 | Steele | |
| 2011/0042407 | A1 | | 2/2011 | Steele | |
| 2011/0103714 | A1 | | 5/2011 | Steele et al. | |
| 2011/0182531 | A1 | | 7/2011 | Steele | |
| 2011/0253728 | A1 | | 10/2011 | Steele | |
| 2012/0074002 | A1 | | 3/2012 | Steele et al. | |
| 2012/0196730 | A1 | | 8/2012 | Steele et al. | |

* cited by examiner

MULTI-COMPARTMENT FLEXIBLE PACKAGE

PRIORITY APPLICATIONS

This application is a Continuation of U.S. application Ser. No. 11/857,292, filed Sep. 18, 2007, which is a Divisional of U.S. application Ser. No. 10/456,971, filed Jun. 6, 2003 now abandoned, which claims priority to and the benefit of U.S. Provisional Application No. 60/386,798, filed Jun. 6, 2002 with each of the above-referenced application disclosures being hereby incorporated by reference in their entirety.

FIELD OF THE INVENTION

The present invention relates generally to flexible packaging and, more particularly, to flexible packaging having at least one segregated internal compartment designed for selective compartmental use.

BACKGROUND OF THE INVENTION

Conventional flexible packaging does not generally include compartments within the internal cavity of the package. Those packages that do, merely provide for a positioned wall down a section of the internal cavity of the main packaging such that a division is merely created within said internal cavity. Distinct and selectively usable compartments within the cavity are not provided for in these conventional package designs.

For instance, U.S. Pat. Nos. 4,201,031, 4,993,844, 5,335,478, and 5,409,116 disclose packages having a divider panel disposed between the two main panels to create a partition. However, since the partition panel spans the full longitudinal distance and is equal in width to the two main panels, the two compartments are accordingly of equal size. Consequently, such partitioned package configurations are not ideal for selective applications and uses where one of the segregated compartments is not required to be identically volumetrically sized with respect to the other. Further, such designs are not ideally compatible with flexible packaging designs employing side or bottom gusset panels. Since the edges of the partition panel are bonded intermediate the edges of the main panel portions, allowing the full length gusseted panels would be rendered unusable as expansion and contraction at the gusset would be restricted by the intermediately bonded partition panel.

Other conventional techniques include creating multi-compartment packages by heat sealing or otherwise bonding two parallel panels proximate the middle portion of the panels such that a divider strip is established. Such designs are demonstrated in U.S. Pat. No. 3,390,507, U.S. Patent Application No. 2002/0067865, and E.P. Patent Publication 594,449A1. The formation and design of these conventional packages merely creates two adjacent packaging portions of substantially equal size. Again, gusseted features are unacceptably limited.

As a result, there is a need for a flexible package that substantially solves the above-referenced problems with conventional package designs, configurations, and manufacturing methods.

SUMMARY OF THE INVENTION

The present invention solves many of the problems that plague conventional flexible packages and packaging methods. Various embodiments of the present invention are directed to a main package and a segregated internal compartment package. The main package generally includes a plurality of outer panel portions. These panel portions can include a front panel portion, a back panel portion, and a bottom panel portion. In addition, the main package can include a first side panel portion, and a second side panel portion. The formation of these panels into the main package defines an internal cavity for holding material contents. Any of the panels can be gusseted with the processes and techniques known to one skilled in the art. The main package includes the segregated internal compartment package, wherein the compartment package can include at least one internal panel portion having a transverse bottom edge portion joined to an inner surface of one of the main package panels within the internal cavity to define a second compartment cavity distinct from the internal cavity of the main package. Further, the present invention can include at least two separate openings into the package to enable selectively separate access into the internal cavity of the main package and the second compartment cavity of the segregated internal compartment package.

In one embodiment, the internal compartment is some size generally smaller than the vertical or longitudinal length of the front and back panels, of varying available width. The internal panel portion can be of a polyethylene, or like plastic or plastic laminate, and is uniquely sealed within the inner cavity at an inner surface of the front or back panels, within the inner cavity. While the outside of the package may look much like any stand up flexible package, there are nonetheless dual top accesses that can be created by a vertical/longitudinal seal of the internal panel portion to clearly identify the two separate cavities.

DETAILED DESCRIPTION OF PREFERRED EMBODIMENTS

Figure 2:
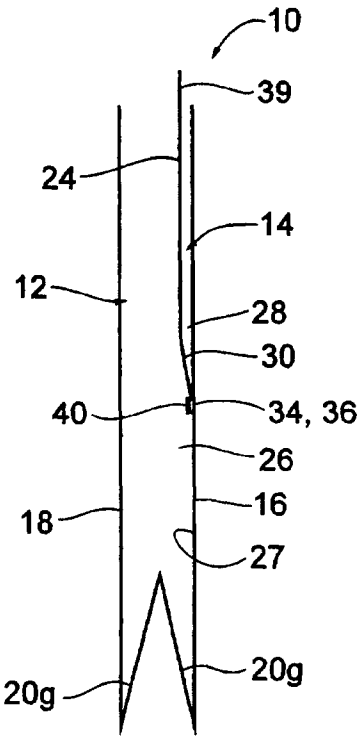
FIG. 2 is a side section view of a multi-compartment package in accordance with an embodiment of the present invention.

Referring to FIGS. 1-9, a flexible package 10 in accordance with the present invention, and the manufacturing steps for forming said flexible package 10, are shown. The package 10 generally includes a main package 12 and a segregated internal compartment package 14. The main package 12 generally includes a front panel portion 16, a back panel portion 18, and a bottom panel portion 20. Further, a top panel portion 21 and/or at least one side panel portion 22 can be included in various embodiments, as demonstrated with side panels 22 in FIGS. 2*b* and 5*b*. Panel portions 16-20 can be joined to form or define an inner cavity 26 of the main package 10 for holding, transporting, or otherwise containing material contents. At least one of the front 16 or back 18 panel portions includes a main sealant surface 27 for bondable joining with selectively positioned portions of the internal compartment package 14. The front panel portion 16 can include front longitudinal edges 17*a*, 17*b* and the back panel portion 18 can include back longitudinal edges 19. The cross-hatching in the figures can be utilized to generally denote the seal lines which are further described herein.

The segregated internal compartment package 14 generally includes at least one internal compartment panel portion 24, wherein the compartment panel portion 24 is peripherally joined to the inner surface of at least one of the main package 10 panel portions to create a second compartment cavity 28. The at least one internal compartment panel 24 includes an internal panel sealant surface 30, longitudinal compartment panel edges 32*a*, 32*b* and transverse compartment panel edges 34.

The package portions 12-22 are generally constructed of flexible sheet material such as polyethylene, polyester, metal foil, polypropylene, or polyethylenes laminated with other materials such as nylon, polyester, and like films. To provide for higher barriers, embodiments can use combination layers of said materials and material of the like. Generally, the confronting or joinable materials of the main package 12 and the internal compartment package 14 must have acceptable sealing characteristics for bonding to the respective target material. For instance, the sealant surface 30 of the internal panel 24 is constructed of a plastic web of polyethylene, or a material with like characteristics and heat bonding qualities for joining to the target main sealant surface 27 of one of the main package panels, such as the front 16 or back 18 panel portions. One skilled in the art will understand that a myriad of materials and material laminates are available for selective use for the main sealant surface 27 and the internal sealant surface 30 to facilitate the bonding attachment described herein. In one embodiment, at least one of the sealant surfaces 27, 30 will comprise "contaminants" that permit a varying level of bonding, wherein the level of bondable attachment is dependent on the heat applied from a corresponding heat sealing bar or other device. Higher temperatures will create "destructive", i.e., permanent, bonds while lower temperatures will create a more temporary bond for selective disengagement. Such bonding techniques can be applied at any sealable surface or region of the main package 12 or the internal compartment package 14 to create the desired level of bonding.

Preferably, the package of the present invention is to be formed into a stand-up pouch, but it could be a three-side-seal pouch, a pouch that displays lying down, or other known pouch or packaging designs and configurations. The internal panel or web 20 can be of the same width and height as the back and/or front panels, or it can be some size smaller, depending on the compartmental needs of the manufacturer or end user. Regardless, and unlike conventional techniques, the transverse compartment panel edge 24 of the internal panel 24 will not be bound to both the front and back panel portions. Instead, the edges 32 of the internal compartment panel 24 will be bonded intermediate the front 16 and back panels 18 and the transverse edge 34 will be bonded to only one of the front 16 or back 18 panels some distance intermediate the bottom and top edges of said one of the front 16 and back 18 panels. In embodiments including the at least one side panel 22, the longitudinal edges 32*a*, 32*b* will also be bonded to the same one of the front 16 or back 18 panels at respective edges 17, 19. Bonding descriptions of the internal compartment panel 24 to various panel designations herein will generally require particular panel portion descriptions for ease of explanation, i.e., panels 16 and 18, but it must be noted that each of the panel portions 16, 18 are interchangeably capable of providing the inner target surface for the internal panel 24 attachment, and the transverse edge 34 in particular. For instance, specific embodiments will require attachment or bonding of the internal panel 24 to the inner surface 27 of the back panel 18 where the outside surface of the front panel 16 includes graphical indicia. Attachment of the internal panel 24 to the back panel 18 will protect the indicia on the front panel 16 as specific sealing processes may require sealing bars to contact the outside of the package to bond the internal panel 24 in place.

Figure 1:
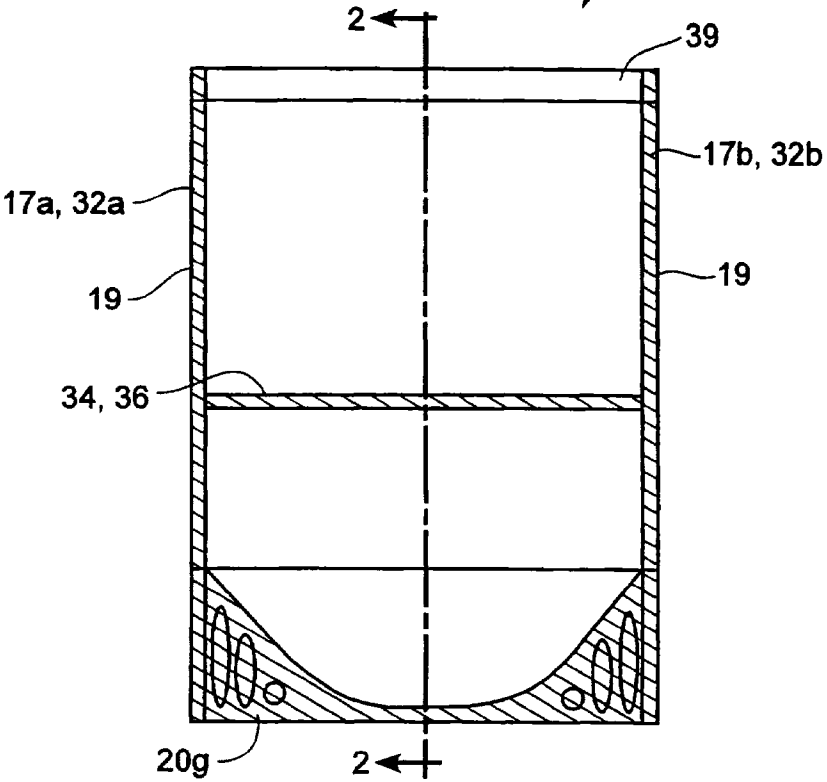
FIG. 1 is a front view of a multi-compartment package in accordance with an embodiment of the present invention.
Figure 2A:
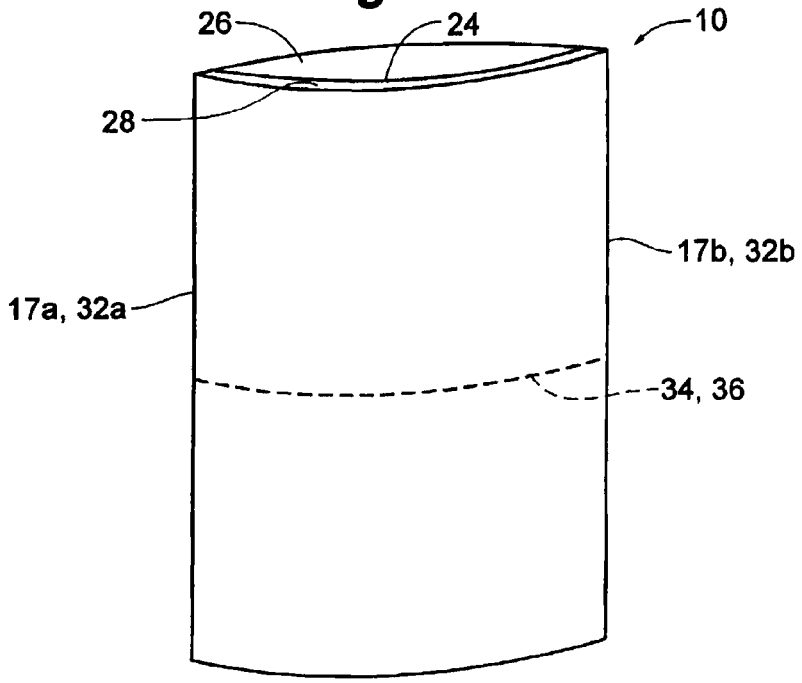
FIG. 2*a* is a perspective view of a multi-compartment package in accordance with an embodiment of the present invention.

In FIGS. 1-2*a*, one embodiment of the package 10 of the present invention is shown. In this embodiment, the internal compartment package 14 is defined by bonding the internal sealant surface 30 at the transverse edge 34 of the at least one internal compartment panel portion 24 to the main sealant surface 27 of the front panel 16, with the back panel 18 being free from bonding contact with the transverse edge 34. Again, the orientation of the panels 16, 18 in relation to the attachment of the internal panel portion 24 is merely for demonstrative purposes and can be interchangeable. Further, the bottom panel 20, or the bottom panel portion 20 defined by joining the ends of the front 16 and back panel 18 portions, is gusseted to create a bottom gusseted panel portion $\mathbf{20}_g$. For ease of explanation and differentiation, gusseted panels are denoted herein with a subscript "g" character. As best demonstrated in FIGS. 1 and 2*a*, the internal panel portion 24 spans substantially the full width of the front panel 16 but is closeably sealed some distances short of the complete longitudinal length of the front panel 16. In this embodiment, the longitudinal edges 32*a*, 32*b* of the internal panel portion 24 are substantially and correspondingly matched and bonded to the longitudinal edges 17*a*, 17*b* of the front panel 16 and the bottom transverse compartment panel edge 34 of the internal panel portion 24 is bonded across the front panel 16 some distance above the bottom panel portion $\mathbf{20}_g$. As such, the transverse edge 34 of the internal panel 24 is attached at a transverse seal 36, transverse to the longitudinal edges 17*a*, 17*b* of the front panel portion 16 and the longitudinal edges 32*a*, 32*b* of the internal panel 24 itself. To prevent the internal panel 24, and the transverse edge 34 in particular, from sealing to the back panel 18 during formation and sealing at the transverse seal 36, a barrier material 40 such as Teflon, Teflon coated materials, or materials of like heat barrier qualities and characteristics can be selectively disposed between the back panel 18 and the internal panel 24 proximate the line of the transverse edge 34. During formation of the package 10, the longitudinal edges 32*a*, 32*b* of the internal panel 24 are bonded intermediate the edge portions 17-19 of the front 16 and back panel 18. The described attachment of the internal panel portion 24 creates the compartment cavity 28, wherein the capacity or volumetric limitations of the compartment cavity 28 are measurably smaller than that of the inner cavity 26 of the main package 10.

Figure 3A:
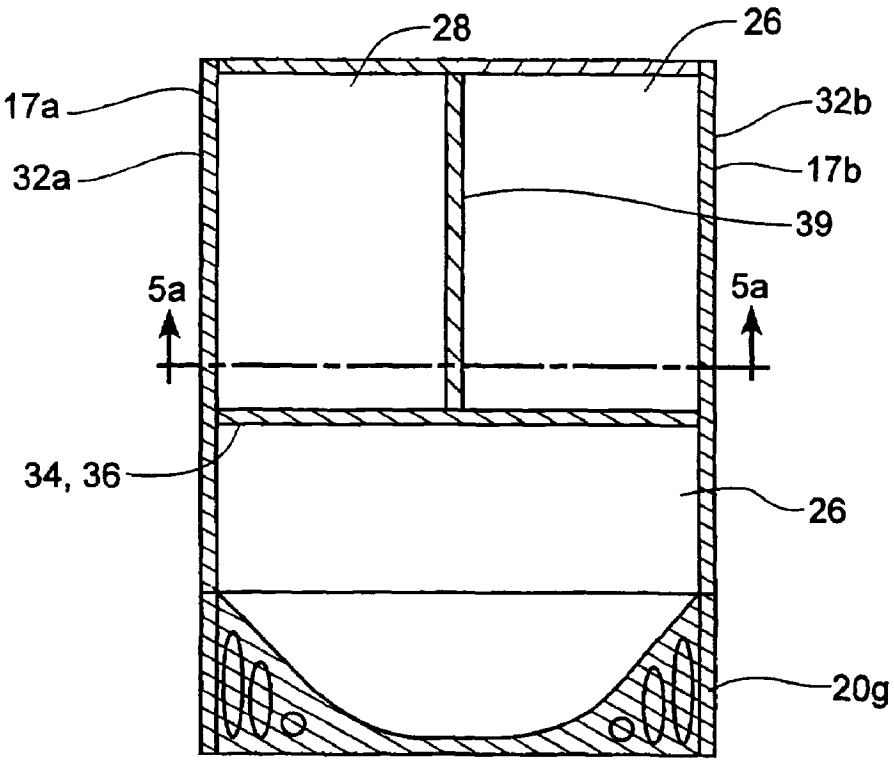
FIG. 3*a* is a front view of a multi-compartment package having a longitudinal seal in accordance with an embodiment of the present invention.

In FIGS. 3-5*e*, another embodiment of the package 10 of the present invention is shown. In this embodiment, the internal compartment package 14 is also defined by bonding the internal sealant surface 30 at the transverse edge 34 of the at least one internal compartment panel portion 24 to the main sealant surface 27 of the front panel 16, with the back panel 18 being free from bonding contact with the transverse edge 34 of the internal panel 24. Further, the bottom panel 20, or the bottom panel portion 20 defined by joining the ends of the front 16 and back panel 18 portions, is gusseted to create a bottom gusseted panel portion $\mathbf{20}_g$. As best demonstrated in FIGS. 3 and 3*a*, the internal panel portion 24 substantially spans the entire width of the front panel 16 and is closeably sealed some distance short of the complete longitudinal length of the front panel 16 at the transverse edge 34 and seal 36. However, while the longitudinal edges 17*a*, 17*b* of the front panel 16 are bonded with the longitudinal edges 32*a*, 32*b* of the internal panel 24, respectively, an intermediate longitudinal seal 38 is provided at some location intermediate the edges 32*a*, 32*b*, as demonstrated in FIGS. 3-3*a*, and 5*b*-5*d*. The bonding at the longitudinal seal 38 traverses from the top of the package 10 down to the transverse edge 34 and seal 36. As such, this creation of the longitudinal seal 38 between or intermediate the longitudinal edges 17*a*, 17*b*, 32*a*, 32*b* creates an internal compartment 14 measurably smaller in width than the overall width of the front panel 16 and the main package 10.

While the transverse seal 36 can create a continuous bond between the front 16 panel and the internal panel 24 along the transverse edge 34, attachment of the back panel 18 to the transverse edge 34 and seal 36 is preferably avoided to maintain the capacity and configuration of the inner cavity 26. Since seal bars and other bonding mechanisms and techniques known to one skilled in the art are easily utilized and often implement a seal bar across the entire width of the package 10 at the line defined by the transverse edge 34, it may be necessary to include a material barrier 40 protection along the line of the transverse edge 34 extending from the longitudinal seal 38 to the longitudinal edges 17*b*, 32*b*. Like the previous embodiment, a barrier material 40 such as Teflon, Teflon coated materials, or materials of like heat barrier qualities and characteristics can be selectively disposed between the back panel 18 and the front panel 16 along the width of the panels. This barrier 40 will prevent bonding of the back panel 18 to the transverse edge 34 along the seal 36 between the edges 17*a*, 32*a* and the edges 17*b*, 32*b*, thus also providing a barrier along the seal 36 between the longitudinal seal 28 and the edges 17*b*, 32*b*. At the same time, a bond is created between the front 16 panel and the internal panel 24 along the length of the transverse seal 36. Various applications of such a barrier material to a selected portion of a package panel known to one skilled in the art can be employed without deviating from the spirit and scope of the present invention. The described attachment of the internal panel portion 24 creates the compartment cavity 28, wherein the capacity or volumetric limitations of the compartment cavity 28 are measurably smaller than that of the inner cavity 26 of the main package 10. The boundaries of the compartment 14 and compartment cavity 28 are generally defined in this embodiment by the u-shaped sealed continuity of the longitudinal edge 32*a*, the transverse edge 34, and the longitudinal seal 38.

Figure 5:
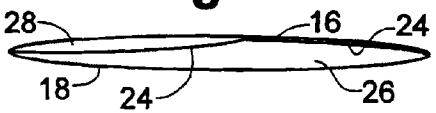
FIG. 5 is a top view of the multi-compartment package of FIG. 3.
Figure 5A:
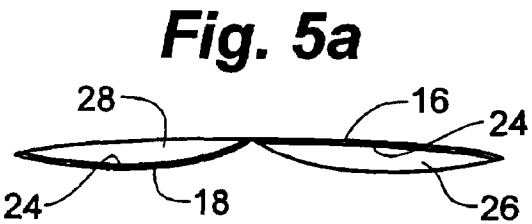
FIG. 5*a* is a top view of the multi-compartment package of FIG. 3*a*.
Figure 5B:
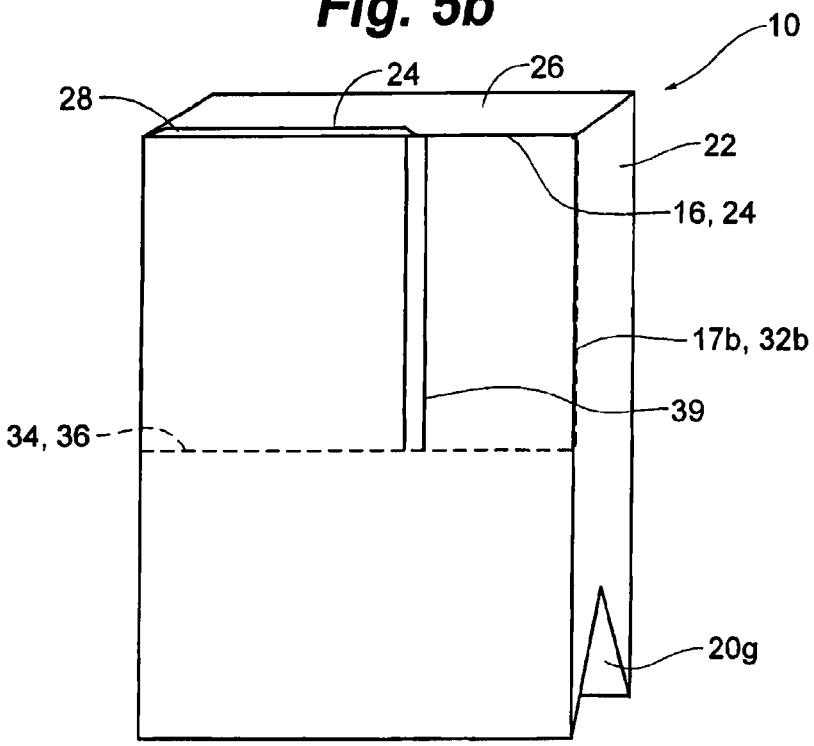
FIG. 5*b* is a perspective view of a multi-compartment package having a longitudinal seal and side panels in accordance with an embodiment of the present invention.
Figure 5C:
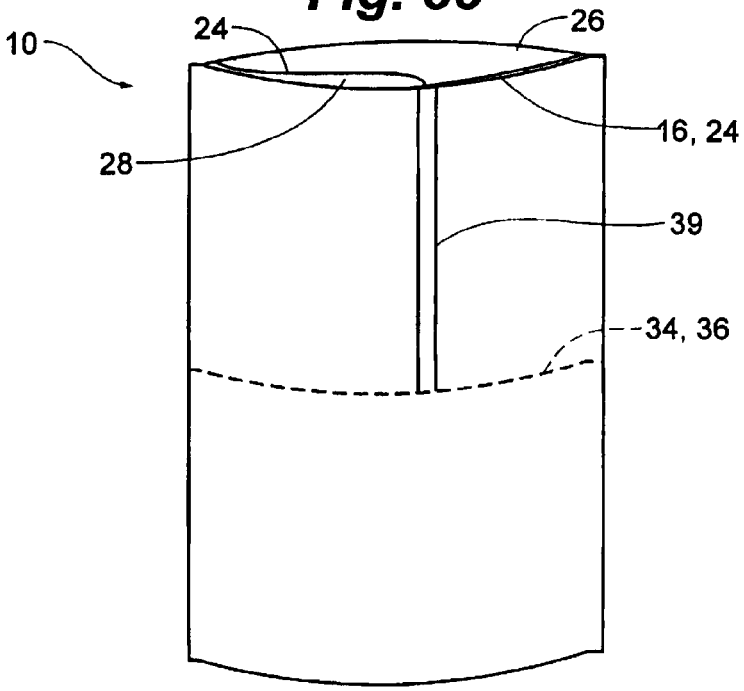
FIG. 5*c* is a perspective view of a multi-compartment package having a longitudinal seal in accordance with an embodiment of the present invention.
Figure 5D:
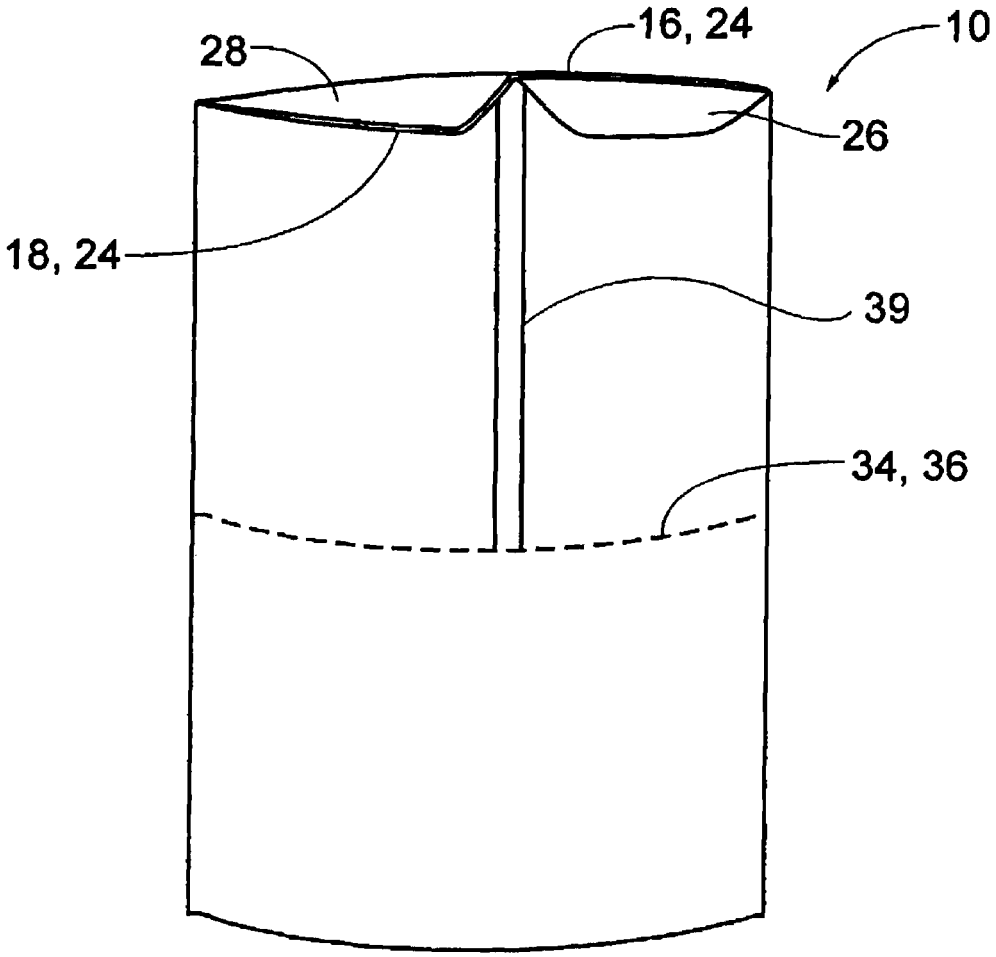
FIG. 5*d* is a perspective view of a multi-compartment package having a longitudinal seal in accordance with an embodiment of the present invention.

With such an embodiment, it may be necessary to additionally bond at least a portion of the top region of the internal panel 24 to the top portion of the front panel 16, distal the transverse seal 36, as shown in FIGS. 5-5*a*, and 5*d*. In FIG. 5, this top portion of the internal panel 24 is sealed to the top portion of the front panel 16 only from the longitudinal seal 38 to the longitudinal edges 17*b*, 32*b*. Accordingly, the openings into the internal compartment cavity 28 and the main inner cavity 26 are distinctly defined. In FIGS. 5*a* and 5*d*, the top portion of the internal panel 24 confronting the top portion of the back panel 18 is sealed between the longitudinal edges 17*a*, 32*a* and the longitudinal seal 38, and the top portion of the internal panel 24 confronting the top portion of the front panel 16 is still sealed to the top portion of the front panel 16 from the longitudinal seal 38 to the longitudinal edges 17*b*, 32*b*. Each of the seals defined herein and shown in FIGS. 5-5*a*, and 5*d* can be temporary or permanent and can be created using materials, techniques, and methods known to one skilled in the art. These embodiments create more defined and distinct openings into the compartment cavity 28 and the inner cavity 26 such that filling of each of said cavities 26, 28 with material and/or fluid contents is easily accomplished by various packagers using known filling techniques and machines. Upon filling of either or both of the cavities 26, 28, the top portions of the front 16 and back 18 panels can be sealed together.

Figure 7:
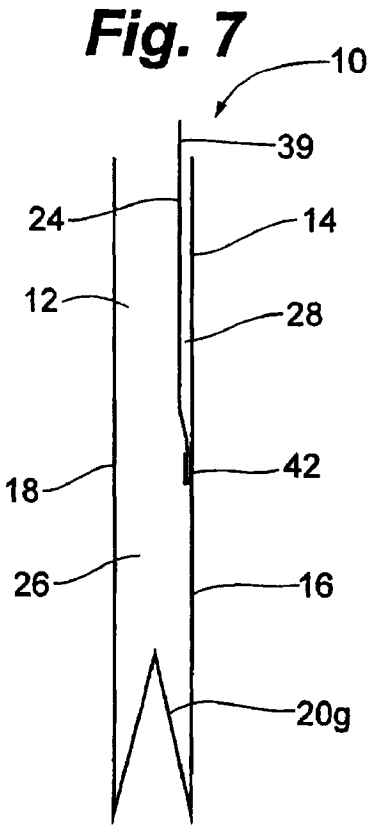
FIG. 7 is a side section view of the multi-compartment package of FIG. 6.
Figure 6:
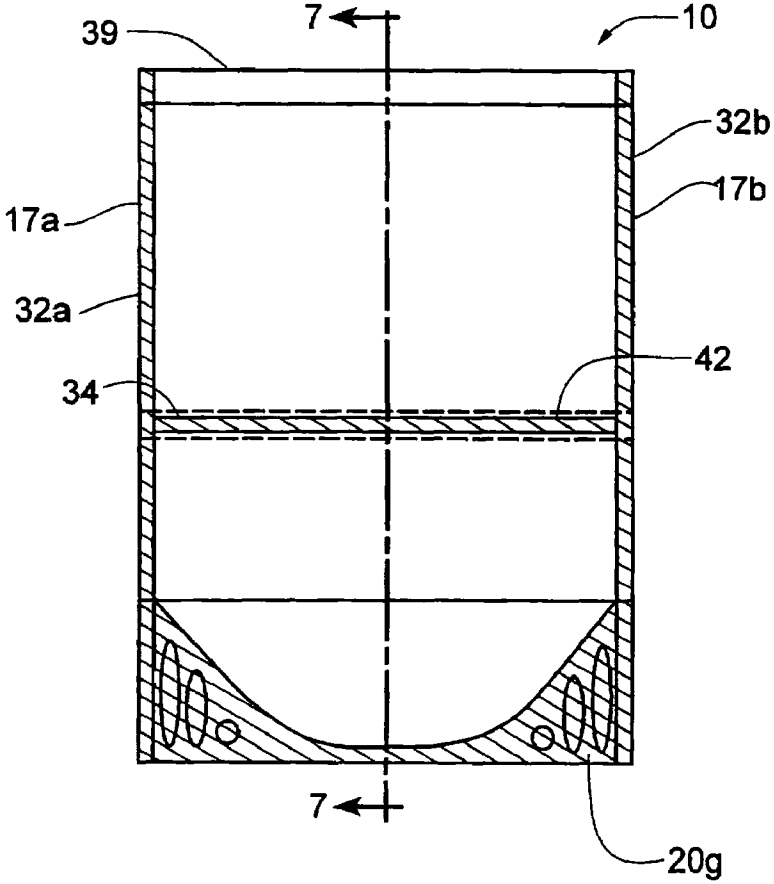
FIG. 6 is a front view of a multi-compartment package having a temporary seal in accordance with an embodiment of the present invention.

Various embodiments of the present invention can include a temporary seal 42 bond along any of the edges or seals of the internal panel 24. Preferably, the temporary seal 42 is provided along the transverse edge 34 of the internal panel 24 to create at least a portion of the transverse seal 36, as shown in FIGS. 6-7. In one embodiment of the temporary seal 42, an adhesive, tape, or other selectively engageable material or substance comprises at least a portion of the transverse seal 36 such that when it is closeably engaged to temporarily bond the transverse edge 34 of the internal panel 24 to the inner surface of one panel of the main package 10, i.e., the sealant surface 27 of the front panel 16, the compartment cavity 28 is segregated from the inner cavity 26. However, when the temporary seal 42 is opened or disengaged, the compartment cavity 28 is brought into fluid communication with the inner cavity 26. Such temporary seal embodiments can be utilized to isolate material contents of the two cavities 26, 28 until such time as it is needed and/or desirable. Medical materials and contents, food, liquids, solids, and a myriad of other materials and substances can be segregated for a desired period of time or use and then selectively brought into communication with such an embodiment. Further, communication between the cavities 26, 28 can be closed by engaging or actuating the temporary seal 42 to again provide desired segregation in those embodiments using adhesives, tapes, and the like.

In one embodiment, the temporary seal 42 will include a compatible tape material such that the temporary bond is broken upon sufficient pressure by the end user on the internal compartment 14 and/or main package 10 structures. In another embodiment, the temporary seal 42 is created by heat sealing the transverse edge 34 of the internal panel 24 to the front 16 or back panel 18 portions in such a manner as to not create a permanent bond. As described herein, this temporary seal 42 generated from a heat sealing technique can comprise selectively utilizing materials with known contaminant characteristics such that a relatively low heat application along the seal 42 provides temporary sealing and avoids a destructive or permanent seal. Various selective and temporary bonding techniques known to one skilled in the art can be employed to implement and create the temporary seal 42 without deviating from the spirit and scope of the present invention. Further, the temporary seal 42 techniques and methods can be included along the longitudinal seal 38 rather than the transverse edge 34 in those packages 10 implementing the compartment package 14 of FIGS. 3-5*d*.

Figure 5E:
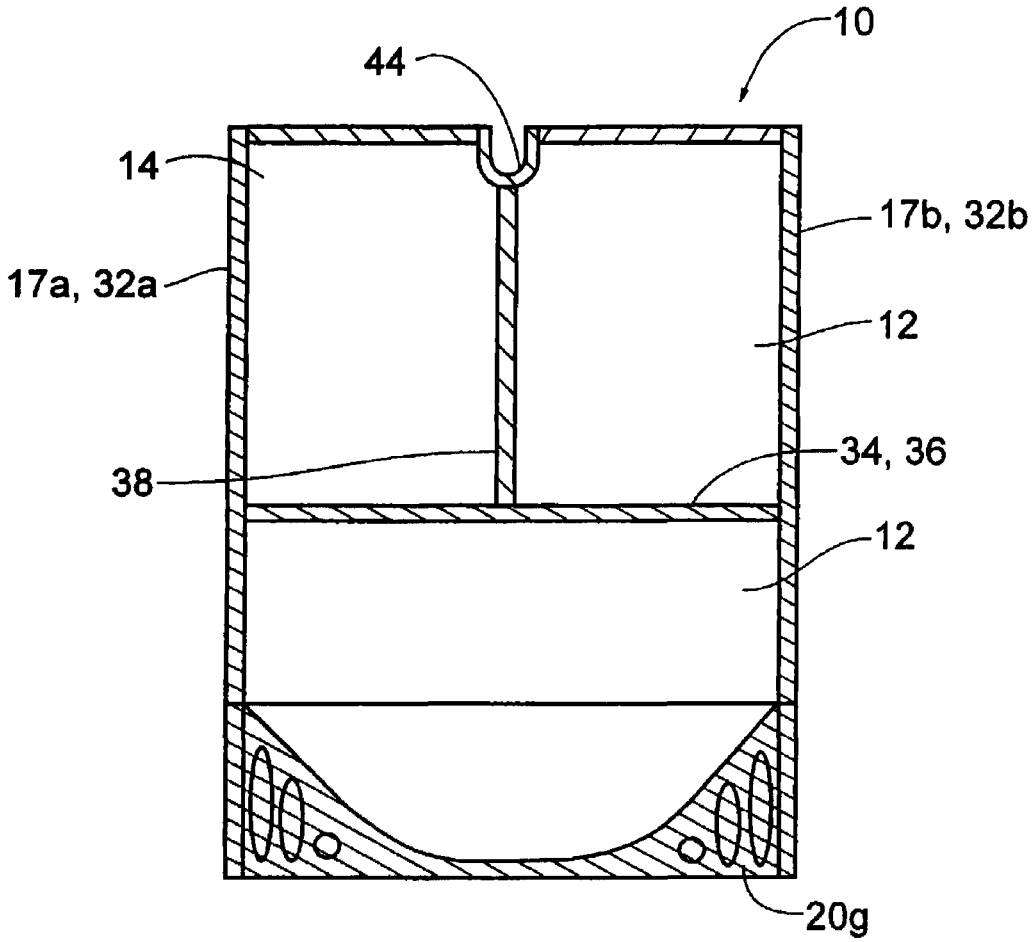
FIG. 5*e* is a front view of a multi-compartment package having a longitudinal seal and notch in accordance with an embodiment of the present invention.

Various embodiments can further include a notch 44, as shown in FIG. 5*e*. This notch 44 is preferably located proximate the longitudinal seal 38 at the top of the package 10 and traverses down into at least the internal panel 24 and one of the front 16 or back 18 panels. A slit can be further provided transversely running into the notch 44 to facilitate selective tearing. This notch 44 permits the end user or packager to selectively open one or both of the compartments 12, 14 to gain access into the corresponding cavities 26, 28. Distinct access is thus permitted. For instance, a user can rip the notch 44 across to edges 17*a*, 32*a* to access the internal compartment 12, while ripping the notch 44 the opposite direction toward edges 17*b*, 32*b* will provide access into the main package compartment 12.

Figure 4:
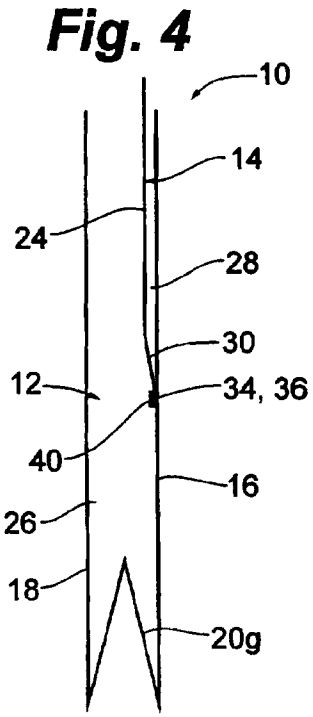
FIG. 4 is a side section view of the multi-compartment package of FIG. 3.
Figure 3:
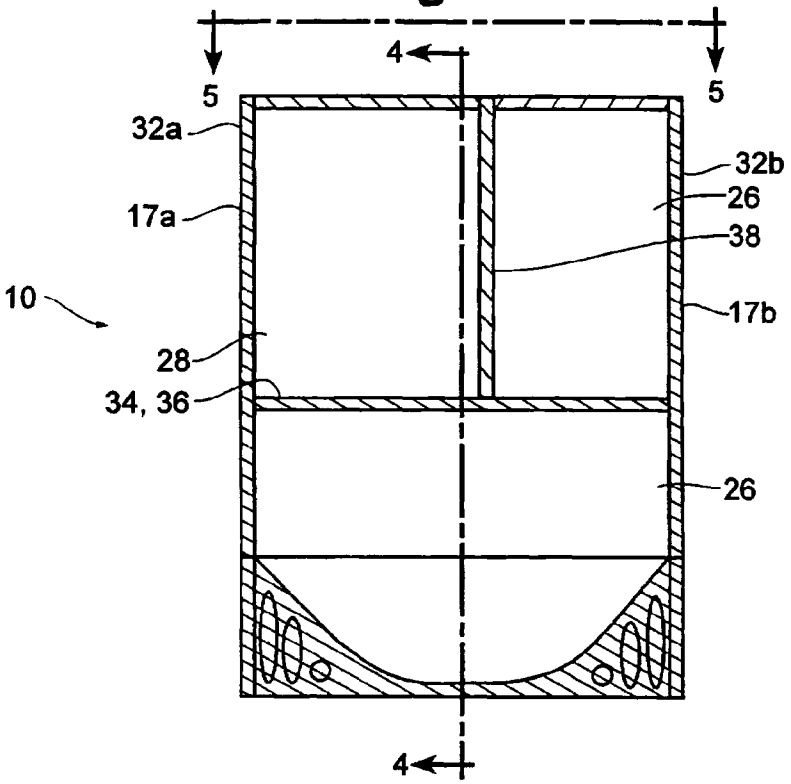
FIG. 3 is a front view of a multi-compartment package having a longitudinal seal in accordance with an embodiment of the present invention.

Each of the embodiments of the present invention can further include a tab or lip portion 39 at the top end portion of the internal panel 24 as shown in FIGS. 2, 4, and 7. The lip portion 39 generally extends some distance outside of the opened package 10 after formation to provide yet another means of facilitating the filling of the inner cavity 26 and/or the compartment cavity 28 with contents. By providing the lip 39, a filling machine, such as a pouch machine, a form-fill-seal machine, a premade pouch filling machine or other like machines known to one skilled in the art can easily push back the internal panel 24 toward a panel (i.e., the back panel 18) of the package 12 opposite the panel having the sealing surface 27 (i.e., the front panel 16). In those packages and embodiments of the present invention attaching the internal panel 24 to the front panel 16, this pushes the internal panel 24 towards the back panel 18 to more clearly define and separate the opening of the inner cavity 26 and the compartment cavity 28 such that contents designated for one cavity will not accidentally enter the other cavity.

Figure 2B:
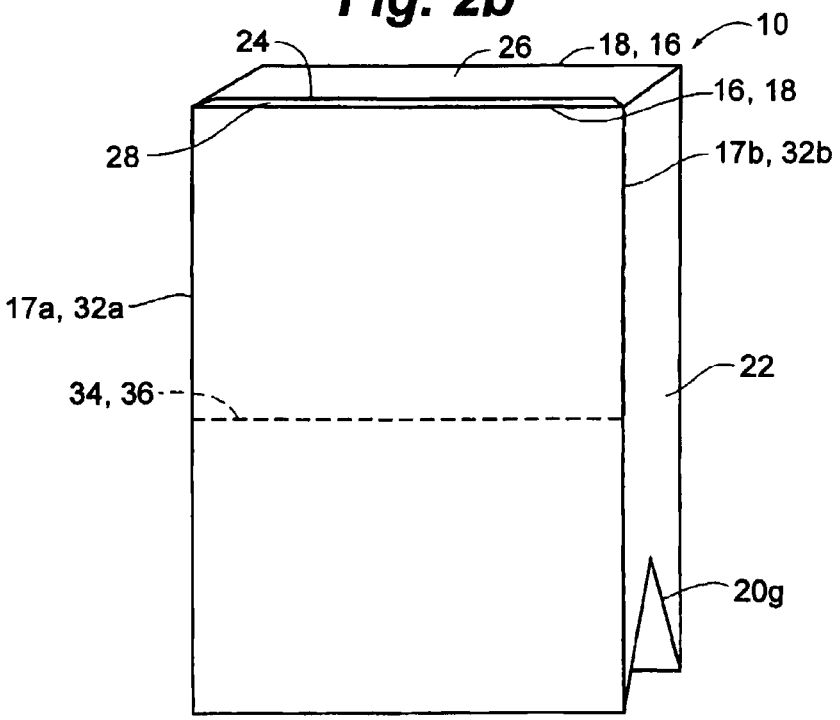
FIG. 2*b* is a perspective view of a multi-compartment package having side panels in accordance with an embodiment of the present invention.

In the embodiments of FIGS. 2*b* and 5*b*, the transverse edge 34 of the internal panel 24 is similarly bonded to only one of the front 16 or back 18 panels. In addition, the inclusion of the at least one side panel 22 makes it possible to only bond the edges 32*a*, 32*b* of the internal panel 24 to the same of the front 16 or back 18 panels. For instance, the edges 19 of the back panel 18 are free from bondable sealing with the edges 17 of the front panel 16 and the edges 32*a*, 32*b* of the internal panel 24. Instead, the edges 32*a* are bonded to edges 17*a* and edges 32*b* are bonded to edges 17*b*. As with the other embodiments, the longitudinal seal 38 can be included, as shown in FIG. 5*b*. To prevent the edges 32*a*, 32*b* from bonding to the back panel 18, the barrier 40 and the various barrier techniques described herein can be employed at any of the sealing regions. With such an embodiment having a side panel 22, expansion of the bottom panel 10, or gusseted bottom panel 20*g*, and expansion of the side panel 22, or side panel 22*g*, is not substantially hindered by the bonded internal panel 24 or its sealed portions.

Figure 8:
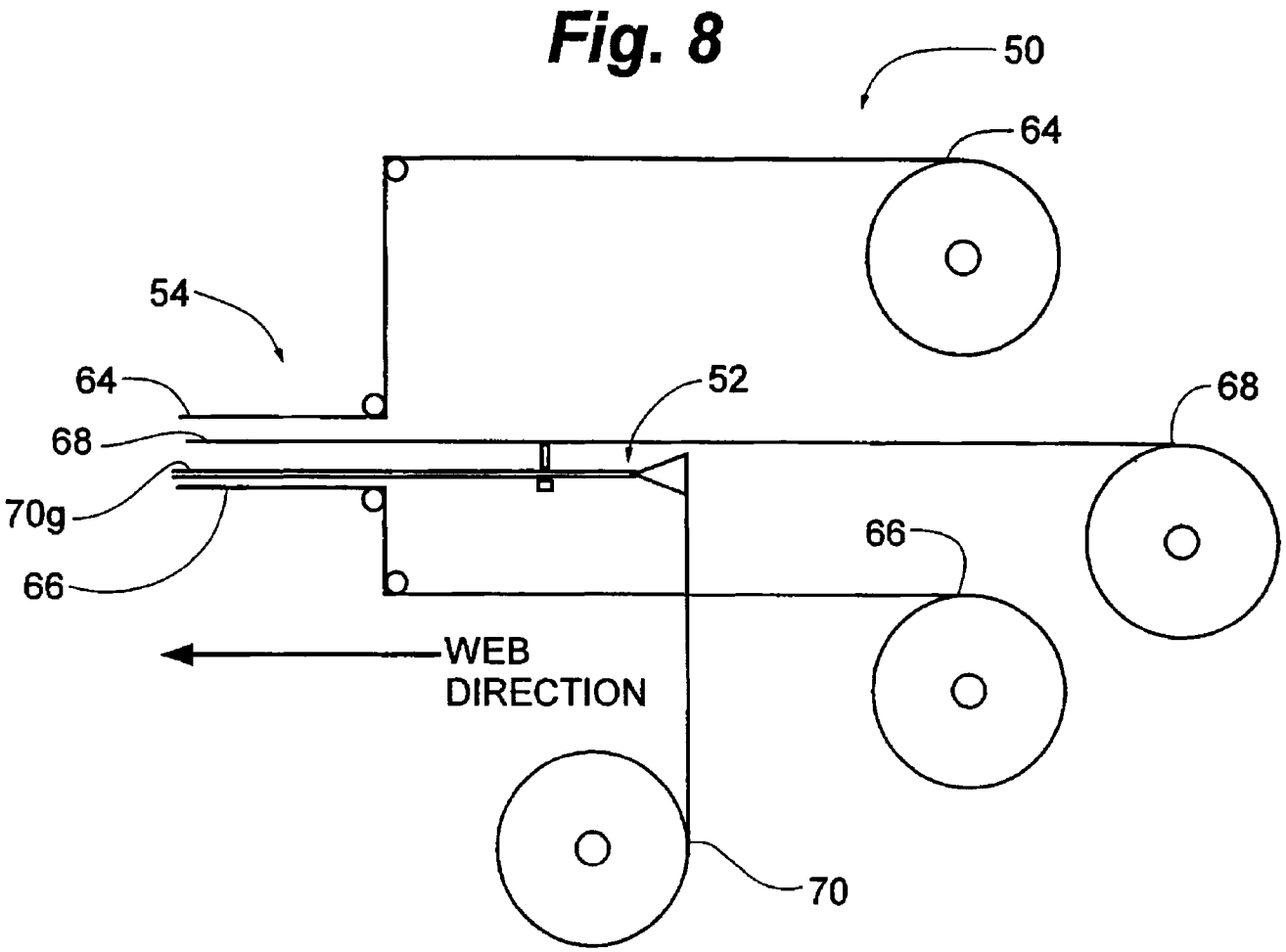
FIG. 8 is a side view of feeding and aligning stations and methods used in forming multi-compartment packages in accordance with embodiments of the present invention.
Figure 9:
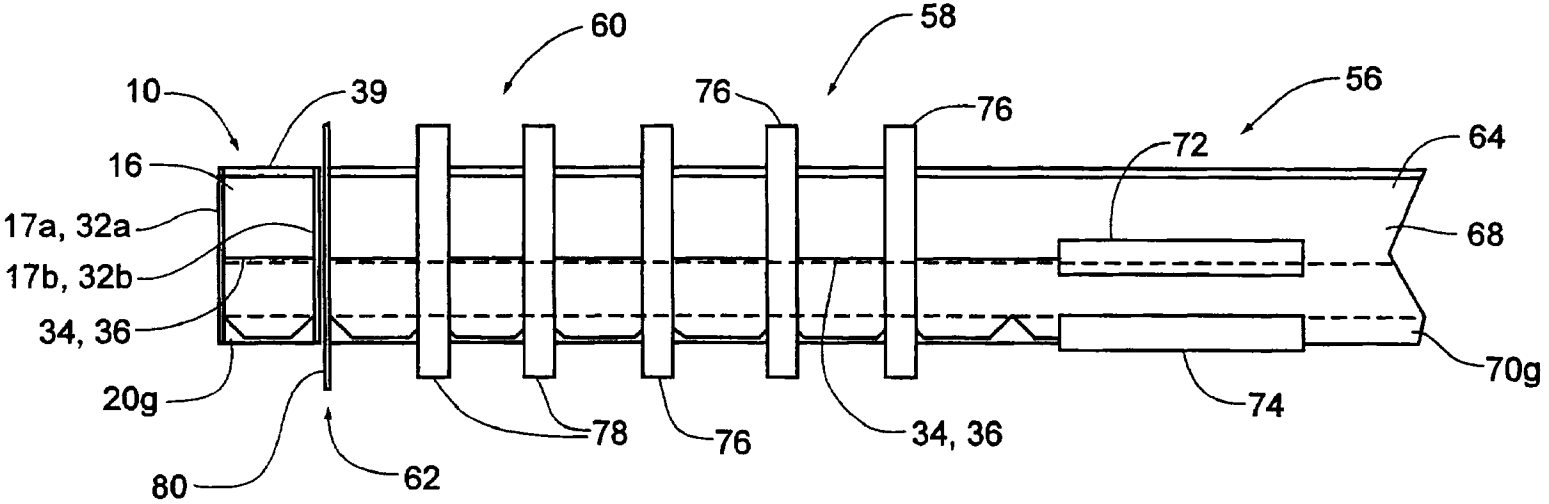
FIG. 9 is a top view of sealing, cooling, and cutting stations and methods used in forming multi-compartment packages in accordance with embodiments of the present invention.

Referring to FIGS. 8-9, the manufacturing process generally includes placing the internal panel portion 24 between the front 16 and back 18 panel portions such that the segregated multi-compartment package 10 of the present invention is formed. This formation process generally comprises a roller feed station 50, a gusseting/folding station 52, an alignment station 54, a first seal station 56, and a side seal station 58. The formation process can further include a cooling station 60 and a cut-off station 62. Each of the base steps in forming the package 10 of the present invention can be performed by known pouch machines, form-fill-seal machines, and like machines known to one skilled in the art for forming pouches and/or forming and filling pouches in the confines of the same manufacturing process.

During formation of the package, the internal panel 24 is fed between the front 16 and back 18 panel portions such that the internal panel 24 extends from the top of the pouch down a distance short of where the folded gusset bottom $\mathbf{20}_g$ starts, depending on the length of longitudinal edges 32*a*, 32*b*. As shown in FIG. 8, at the roller feed station 50, a front panel web roll 64, a back panel web roll 66, an internal panel web roll 68, and a bottom panel web roll 70 are each individually positioned and fed along a general web direction using rollers, brackets, guides, and other techniques and mechanism known to one skilled in the art for forming flexible packages. The sealant surface 27 of the front panel web roll 64 is facing inward toward the alignable internal web 68 and the internal panel sealant surface 30 of the internal panel web roll 68 is likewise facing out toward the alignable front panel web roll 64. Prior to final alignment of the webs 64-70 before bondable sealing, the bottom web 70 can be gusseted at the gusseting station 52 using known techniques, mechanisms and methods known to one skilled in the art. For instance, a v-bracket can be inserted along an intermediate portion of the bottom web 70 as it is being fed through the process such that a gusset fold forms web $\mathbf{70}_g$ to define what will be bottom panel $\mathbf{20}_g$ for each of the packages 10.

Referring primarily to FIG. 9, the aligned webs 64, 66, 68, and $\mathbf{70}_g$ are positioned or laid upon each other and fed into the first seal station 56. At this station, seals running along the line of the web direction but transverse to the orientation of the final package 10 can be employed. Specifically, a first seal bar 72 can contact the outer surface of a panel, such as a portion of the front panel web 64 (or the back panel web 66) to create the transverse seal 36, and/or the temporary seal 42 to bondably attach the transverse edge 34 of the internal web 68. Further, a second seal bar 74 can contact the outer surface of the front panel web 65 (or the back panel web 66) to fully seal the bottom gusseted panel web $\mathbf{70}_g$ to the front web 65 and/or the back web 66. Following these seals at the first seal station 56, the now partially-sealed webs 64, 66, 68, and $\mathbf{70}_g$ continue along the web direction to the side seal station 58. The side seal station 58 can include at least one side seal bar 76, and preferably two side seal bars 76, positioned and designed to contact the outer portion of the webs to intermediately seal the longitudinal edges 32 of the internal panel web 68 to the respective confronting edges 17, 19 of the front 64 and back 66 panel webs. A seal bar can be implemented at this stage to selectively seal along the package to form the longitudinal seal 38 described herein. As previously indicated, pieces or strips of Teflon, or similar materials having beneficial heat resistant qualities have been placed at the designated target regions described herein so that unwanted bonding of particular panel portions is avoided. Following the sealing at the side seal station 58, the boundaries and seals for the internal compartment package 14 and the main package 12 are defined for each contiguous package 10 passing along the web path of the machine.

As the now forming package 10 leaves the side seal station 58 along the web path of the machine, each package 10 can enter a cooling station 60. The cooling station 60 can include at least one cooling bar 78 which is applied along the various seals, i.e., the seals created at the side seal station 58, to lower the web material temperature to further promote and stabilize the bonds created. Once the cooling bars 78 have performed the cooling functions required upon application, each package 10, still contiguously linked, can be separated to define the distinct package 10 at the cut-off station 62. The cut-off station 62 can include a cutting device 80 such as a blade or other known mechanism that can trim the edges of the package 10 and cut the end package 10 from the adjacently joined package 10. Other trimming devices and mechanisms can further be employed to trim the various edges of the package 10.

With this manufactured package product, a compartmentalized package is created such that there is no mingling or intrusion of the contents of the distinct compartments 12, 14 and corresponding cavities 26, 28. In addition, the transverse edge 34 of the internal panel 24 is bonded only to one of the selected target panels 16, 18. This leaves the remaining panel not targeted for receiving the internal panel 24 free for movement. For instance, a bottom panel $\mathbf{20}_g$ and/or a side panel $\mathbf{22}_g$ are free to expand or contract contingent upon the insertion or removal of contents within the inner cavity 16, thus not detrimentally affecting the functionality of the package 10 or the capacity or functionality of the compartment cavity 28. Each cavity 26, 28 and package portion 12, 14 is substantially independent from the other. Various handles, graphics, closeable and re-closeable devices, gusseted portions, and like features known to one skilled in the art are also envisioned for use with this invention and can be implemented without deviating from the spirit and scope of the present invention. All references to front, back, bottom, and the like are merely for demonstrative purposes and are not intended to limit the variations and positional references and orientations of the panels in the present invention.

The present invention may be embodied in other specific forms without departing from the spirit or essential attributes thereof, and it is, therefore, desired that the present embodiment be considered in all respects as illustrative and not restrictive. Similarly, the above-described methods and techniques for manufacturing the present invention are illustrative sequential processes and are not intended to limit the methods of manufacturing the present invention to those specifically defined herein. It is envisioned that various depicted steps can be performed in differing substantive and sequential order. In addition, various unspecified steps and procedures can be performed in between those steps described herein without deviating from the spirit and scope of the present invention and the method of manufacturing the same.

What is claimed is:

1. A method of forming a multi-compartment package, comprising:

providing a first panel portion including an inner first panel surface, an outer first panel surface, first panel longitudinal edge portions, a bottom portion, and a top portion;

providing a second panel portion including an inner second panel surface, an outer second panel surface, second longitudinal edge portions, and a top portion, wherein at least the first panel portion and the second panel portion define a main inner cavity;

providing an internal compartment panel having first and second compartment longitudinal edge portions, a bottom transverse edge portion, a first top edge portion, and a second top edge portion;

applying a longitudinal seal to a portion of the intermediate compartment panel and a portion of the inner first panel surface intermediate the first panel longitudinal edge portions;

applying a first seal to the top portion of the first panel portion and the first top edge portion of the internal compartment panel, from one of the first panel longitudinal edge portions to the longitudinal seal, without sealing to an opposing portion of the second panel portion;

applying a second seal to the top portion of the second panel portion and the second top edge portion of the internal compartment panel, from one of the second panel longitudinal edge portions to the longitudinal seal, without sealing to an opposing portion of the first panel portion; and applying a transverse seal to the inner first panel surface and the bottom transverse edge portion of the internal compartment panel, intermediate the top portion and the bottom portion of the first panel, and wherein a secondary compartment is defined separate from the main inner cavity.

2. The method of claim 1, further including providing a bottom panel portion.

3. The method of claim 2, wherein the bottom panel is gusseted.

4. The method of claim 1, wherein the main inner cavity is adapted to hold first material contents.

5. The method of claim 4, wherein the first material contents include a liquid.

6. The method of claim 4, wherein the secondary compartment is adapted to hold second material contents different from the first material contents.

7. The method of claim 6, wherein the second material contents include a liquid.

8. The method of claim 6, wherein the second material contents include a food material.

9. The method of claim 6, wherein the second material contents include a solid.

10. The method of claim 1, wherein at least a portion of one of the longitudinal seal or the transverse seal includes a temporary seal bond.

11. The method of claim 1, wherein at least a portion of one of the longitudinal seal or the transverse seal includes an adhesive material.

12. The method of claim 1, wherein at least a portion of one of the longitudinal seal or the transverse seal is adapted to selectively breach.

13. The method of claim 1, further including applying a top seal to at least the first and second top edge portions of the internal compartment panel, the top portion of the first panel portion, and the top portion of the second panel portion.

14. A method of forming a multi-compartment package, comprising:

providing a first panel portion including an inner first panel surface, an outer first panel surface, first panel longitudinal edge portions, a bottom portion, and a top portion;

providing a second panel portion including an inner second panel surface, an outer second panel surface, second longitudinal edge portions, and a top portion, wherein at least the first panel portion and the second panel portion define a main inner cavity;

providing an internal compartment panel having first and second compartment longitudinal edge portions, a bottom transverse edge portion, a first top edge portion, and a second top edge portion;

applying a longitudinal seal to a portion of the intermediate compartment panel and a portion of the inner first panel surface intermediate the first panel longitudinal edge portions;

applying a first seal to the top portion of the first panel portion and the first top edge portion of the internal compartment panel, from one of the first panel longitudinal edge portions to the longitudinal seal, without sealing to an opposing portion of the second panel portion; and applying a second seal to the top portion of the second panel portion and the second top edge portion of the internal compartment panel, from one of the second panel longitudinal edge portions to the longitudinal seal, without sealing to an opposing portion of the first panel portion, and wherein a secondary compartment is defined separate from the main inner cavity.

15. The method of claim 14, further including applying a transverse seal to the inner first panel surface and the bottom transverse edge portion of the internal compartment panel.

16. The method of claim 15, wherein the transverse seal is applied above the bottom portion of the first panel.

17. The method of claim 14, wherein the main inner cavity is adapted to hold first material contents.

18. The method of claim 17, wherein the secondary compartment is adapted to hold second material contents different from the first material contents.

19. The method of claim 14, wherein at least a portion of the longitudinal seal includes a temporary seal bond.

20. The method of claim 15, wherein at least a portion of the transverse seal includes a temporary seal bond.

21. The method of claim 15, wherein at least a portion of the transverse seal is adapted to selectively breach.

22. The method of claim 14, further including filling at least one of the main inner cavity and the secondary compartment with material contents and applying a top seal to at least the first and second top edge portions of the internal compartment panel, the top portion of the first panel portion, and the top portion of the second panel portion.

* * * * *